US005653252A

United States Patent [19]

Steg et al.

[11] Patent Number: 5,653,252

[45] Date of Patent: Aug. 5, 1997

[54] DRAIN VALVE FOR A FLUSH TANK

[75] Inventors: Marco Steg, Jona; Alois Diethelm, Vorderthal, both of Switzerland

[73] Assignee: Geberit Technik AG, Jona, Switzerland

[21] Appl. No.: 593,921

[22] Filed: Jan. 30, 1996

[30] Foreign Application Priority Data

Feb. 13, 1995 [CH] Switzerland ..... 413/95

[51] Int. Cl.[6] ..... F16K 31/22; F16K 33/00; E03D 1/35

[52] U.S. Cl. ..... 137/315; 4/378; 4/391; 4/415; 137/410; 137/426; 137/433; 137/436; 251/205

[58] Field of Search ..... 4/378, 391, 395, 4/415, 366, 389, 390; 137/410, 426, 430, 433, 436, 441, 442, 443, 444, 15, 315; 251/48, 205, 208

[56] References Cited

U.S. PATENT DOCUMENTS

| | | | |
|---|---|---|---|
| 2,010,119 | 8/1935 | Tilden | 4/391 |
| 2,077,832 | 4/1937 | Gebert | 4/391 |
| 3,969,774 | 7/1976 | Karlsson | 4/391 |
| 4,011,605 | 3/1977 | Karlsson et al. | 4/391 |
| 4,101,986 | 7/1978 | Ng et al. | 4/325 |
| 4,357,720 | 11/1982 | Stähli | 4/391 |
| 4,486,906 | 12/1984 | Meier | 4/391 |
| 5,349,981 | 9/1994 | Schmucki et al. | 137/432 |

FOREIGN PATENT DOCUMENTS

| | | | |
|---|---|---|---|
| 2658219 | 8/1991 | France | 4/391 |
| 4113497 | 10/1992 | Germany | 4/391 |
| 9311189.4 | 10/1993 | Germany . | |
| 587295 | 1/1959 | Italy | 4/391 |
| A-386351 | 4/1965 | Switzerland . | |
| 386351 | 4/1965 | Switzerland . | |
| 560295 | 3/1975 | Switzerland . | |
| 2065737 | 7/1981 | United Kingdom | 4/391 |

*Primary Examiner*—George L. Walton
*Attorney, Agent, or Firm*—McGlew & Tuttle

[57] ABSTRACT

In a housing to be fastened to the bottom of a flushing tank, a float, which is arranged approximately centrally on a closing member mounted displaceably in the housing, is arranged under a partition extending horizontally in the flush tank. A sealing body is arranged at a lower end of the closing member. The partition forms a unit with a chamber arranged on its underside, and the unit is detachably inserted from the top into the housing, which is open at the top. The present invention simplifies the automatic mounting as well as the inspection of the drain valve and the more universal and therefore less expensive use of the valve housing.

18 Claims, 3 Drawing Sheets

DRAIN VALVE FOR A FLUSH TANK

FIELD OF THE INVENTION

The present invention pertains to a drain valve for a flush tank, especially for a toilet flush tank, in which a float is arranged in a housing to be fastened to the bottom of the flush tank under a partition extending horizontally in the housing, and the float is arranged on a closing member, which is displaceably mounted in the housing, has a sealing body at a lower end and extends with a top end out of the housing through an opening of the housing.

BACKGROUND OF THE INVENTION

A drain valve of this type has been known from, e.g., CH-A-386,351. The housing, called a bell there, is inserted into an opening in the bottom of the flush tank and is firmly screwed together with same. The float, which is rigidly connected to the overflow pipe, is accommodated in a circular cylindrical space, which is open at the bottom, under a partition or cover wall of the bell. The overflow pipe forms a closing member with a valve disk arranged at the lower end. To trigger a flushing, the closing body or the overflow pipe with the float fastened thereto is raised until the float comes into contact with the underside of the partition. The valve disk of the closing member is thus lifted off from the valve seat and the valve is thus opened. Flushing water present in the flushing tank flows through lateral windows in the bell into, e.g., a connected toilet bowl. The drain valve closes as soon as air enters into the area under the partition through a gap between the overflow pipe and the bell. The mounting of this drain valve is not quite simple, because the valve tube with the valve disk must be inserted into the bell from below. This is difficult especially when means for controlling the rate of lowering are to be mounted in the drain valve.

SUMMARY AND OBJECTS OF THE INVENTION

The primary object of the present invention is to provide a drain valve of the type which can be mounted and removed more simply. The object is attained in a drain vane of this type by the partition with a chamber arranged under it forming one unit, which is removably inserted from the top into the housing, which is open at the top.

In the drain valve according to the present invention, the housing or the bell without the unit can be fastened to the bottom of the tank. The unit with the closing member can subsequently be inserted into the housing from the top by means of an automated mounting device. At the time of an inspection, the unit with the closing member can be removed from the housing from the top, and the housing may remain on the bottom of the tank. Since the partition is no longer arranged rigidly on the housing in the drain valve according to the present invention, the height of the partition can be adapted to the valve seat in a simple manner by using different housings. It is thus possible to use the same unit for different flushing tanks. For example, a correspondingly tall housing may be used for a concealed flushing tank with a partition arranged at a relatively high level. The use of the drain valve according to the present invention can thus be used in a highly universal manner.

The unit is preferably rotatably mounted in the housing. An upwardly extending tubular wall, which is connected to the cover of the housing, is preferably fastened at the top of the partition. The cover is preferably detachably connected to the unit and to the housing. The cover engages the wall fastened at the top of the partition to detachably hold the wall. The chamber and the tubular wall are preferably made in one piece with a partition. The unit can preferably be rotated in relation to the housing between at least two predetermined rotation positions to regulate the rate of closing. Air can enter into the chamber arranged under the partition through the opening from the outside of the housing in one rotation position for premature closing with partially emptied flushing tank. The air can enter into the channel between the unit and the housing from the inside of the housing and the chamber arranged under the partition from there in one rotation position for retarded closing with the flushing tank partially emptied.

For setting the rotation position, the housing has support cams projecting on the inside and the unit has stop cams cooperating with the support cams. The recesses extending between the stop cams are arranged on the outside of the unit. The rotation positions preferably can be fixed by snapping means.

Under the partition and above the partition the unit preferably has at least one opening through which air can enter into the area under the partition from the top side of the partition. The unit has a longitudinal slot through which air can enter into the chamber, arranged under the partition from the outside of the housing from the passage opening in the housing when the longitudinal slot and the passage opening are aligned.

The cover is preferably detachably snapped into the housing by means of projecting brackets for rotatably fastening the unit to the housing. The brackets are preferably made to be flexible, formed in one piece with the cover.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
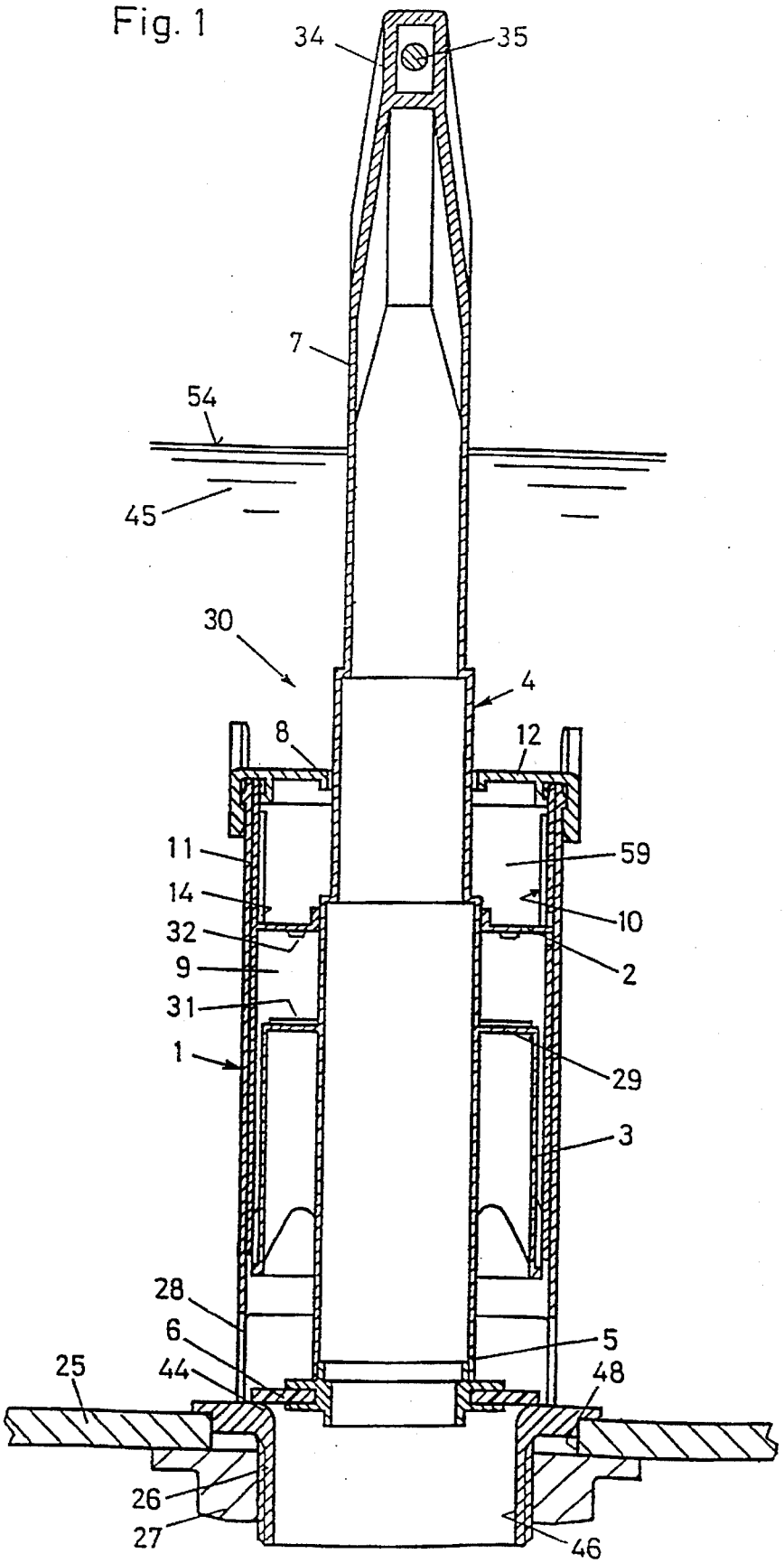
FIG. 1 is a longitudinal sectional view through a drain valve according to the present invention, mounted in a flushing tank.
Figure 4:
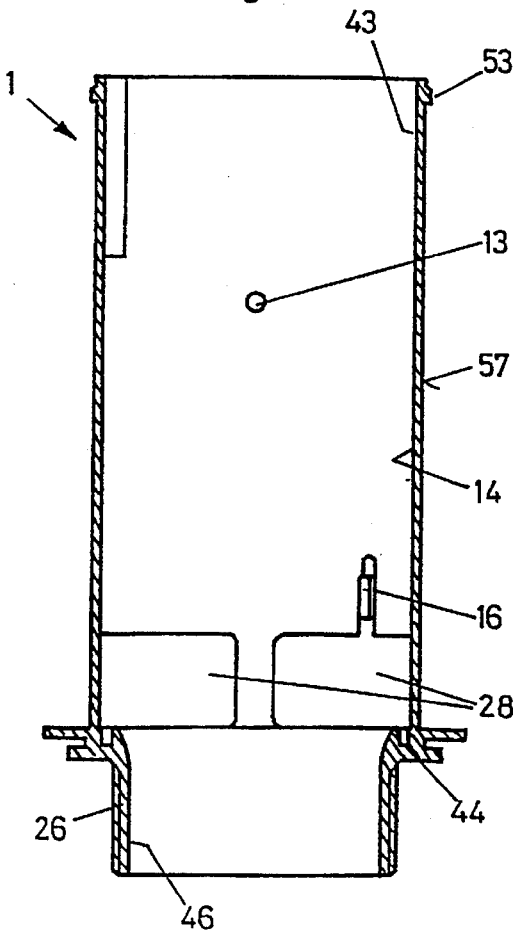
FIG. 4 is a section through the housing.

FIG. 1 shows a drain valve 30, which has a tubular housing 1, with which a threaded pipe 26, which is inserted into an opening 48 of a flushing tank bottom 25 and is tightly clamped onto same, is made in one piece. A unit 10, with which a horizontal partition 2 with a central opening 33 is made in one piece, is placed into an upper, round opening 43 (FIG. 4) of the housing 1. A closing member 4, which is designed as an overflow pipe, is placed from below into the opening 33, and the closing member 4 has, at its lower end 5, a valve disk 6, which forms a sealing body and cooperates with the valve seat 44. A bracket 34, which is engaged by a lever 35 of an actuating means, not specifically shown here, is made in one piece with the top end 7 of the closing member 4. The closing member 4 can be raised with this actuating means, and the valve can be opened as a result. With the valve opened, flushing water 45 present in the flushing tank can flow into a toilet bowl, not shown here, through lateral windows 28 of the housing 1 and an opening 46 of the pipe 26.

Figure 2:
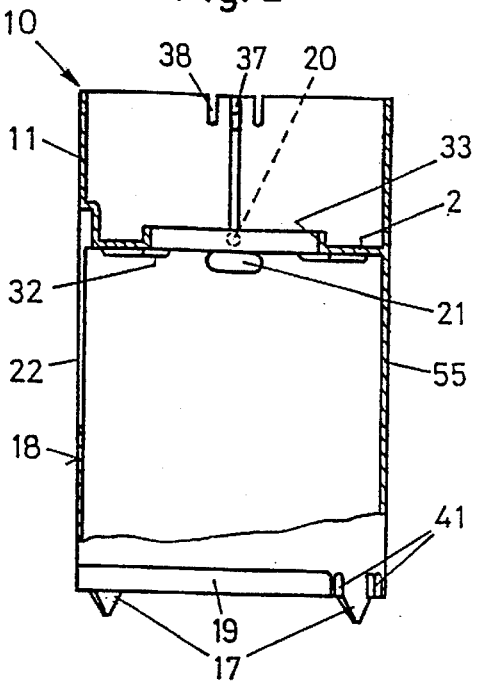
FIG. 2 is a partially cutaway view of a unit.
Figure 3:
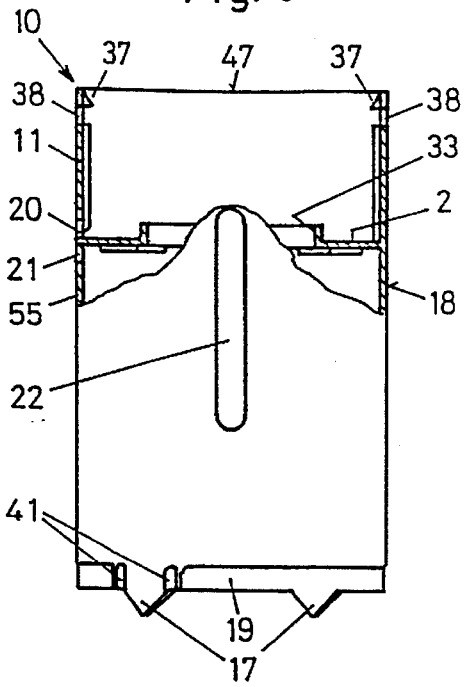
FIG. 3 is a partially cutaway section through the housing.

The housing 1 and the unit 10 are detachably connected to one another with a circular cover 12 manufactured separately. A snap-in ring 36, into which two opposite snap-in teeth 37 of the unit 10 snap from below, is made in one piece with the cover 12 on the underside for this purpose. According to FIGS. 2 and 3, these snap-in teeth 37 are made in one piece with an upper edge 47 of a beaker-shaped wall 11. Recesses 38 on the side of, next to and under the teeth 37 make possible a radial deflection during the snapping in of these teeth. The unit 10 is mounted rotatably on the ring 36, and the teeth 37 can slide along the snap-in ring 36 in the circumferential direction.

Figure 8:
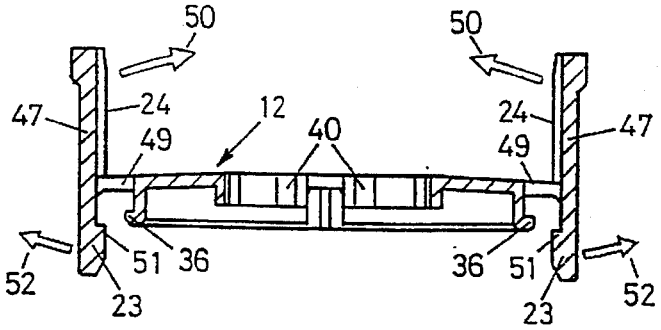
FIG. 8 is a section through a cover.

In addition, the cover 12 has two opposite brackets 24, which extend vertically upward and downward at the edge of the cover according to FIG. 8. The brackets 24 are made in one piece with the cover 12 to the side of an opening 49 of the cover 12. The upper area 47 of the brackets 24 forms a grip, by which the brackets 24 can be elastically pivoted in the direction of the arrows 50. The snap-in teeth 51 made in one piece in a lower area 23 of the brackets 24 are now pivoted to the outside in the direction of the arrows 52. The engagement of the teeth 51 with another circumferential snap-in ring 53 of the housing 1 can thus be abolished and the unit 10 can be lifted out of the housing 1 or be rotated on same as desired. When the cover 12 is placed on the housing 1, the brackets 24 snap automatically into the snap-in ring 53 while being elastically deflected. The assembly of the housing 1 with the unit 10 and the cover 12 can be carried out in a very simple manner automatically by fitting together. Disassembly is possible repeatedly without tools and in a very short time.

The tubular closing member 4 is guided longitudinally displaceably by projecting guide ribs 40 in the opening 8 of the cover 12. Lateral slots 39 allow the passage of air from the interior of the flushing tank into an annular space 59 of the unit 10 as soon as the level 54 of the flushing water 45 has dropped below these slots 39 during a flushing process.

Figure 5:
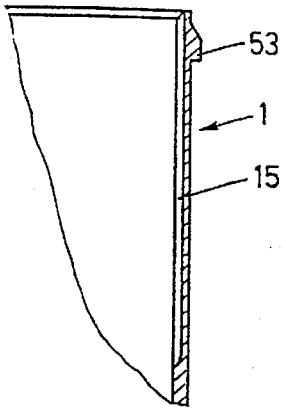
FIG. 5 is a section through part of the housing.
Figure 11:
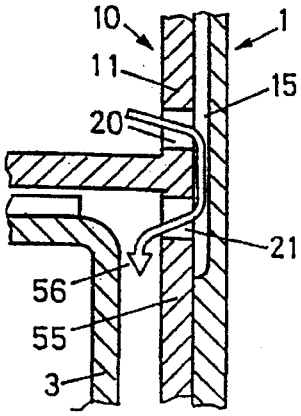
FIG. 11 is a schematic view showing the triggering of the closing process.

To enable air having entered into the chamber 59 to reach the area under the partition 2 to interrupt the flushing, at least one opening 20 or 21 each is arranged according to FIG. 11 above and under the partition 2 in the wall 11 as well as in a tubular wall 55 joining it at the bottom. The air can enter into a chamber 9 under the partition 2 from the opening 20 via an opening 21 when the unit 10 is turned into a position in which the openings 20 and 21 are arranged in the area of an elongated, vertically extending depression 15 of the inner side of the housing 1. The depression is shown in FIG. 5. The path of the air into the chamber 9 is indicated by arrow 56 in FIG. 11. The passage through the openings 20 and 21 as well as the depression 15 are dimensioned such that the water in the annular space 53 flows off relatively slowly, and the valve opens only when air enters into the chamber 9 and the flushing tank is essentially completely emptied. As is shown, the depression 15 extends in the vertical direction of the housing 1 and has approximately equal depth and width everywhere. The openings 20 and 21 as well as the partition 2 can thus be arranged at any desired height of the depression 15, without thereby influencing the rate of lowering of the closing member 4.

Figure 10:
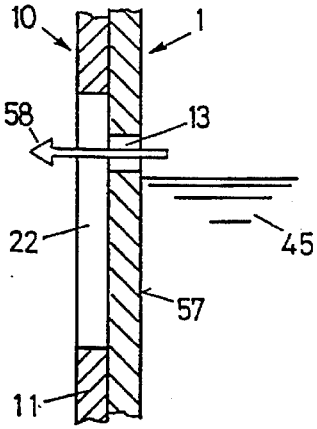
FIG. 10 is a schematic view showing the triggering of the closing process.
Figure 9:
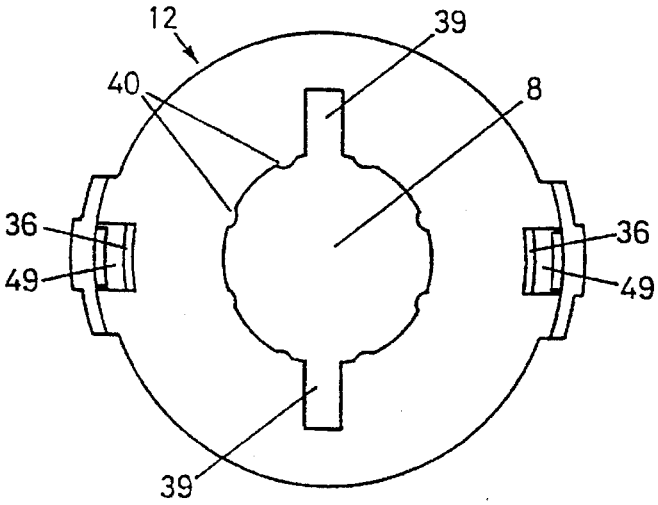
FIG. 9 is a view of the cover according to FIG. 8.

If the drain valve 30 is to close before the complete emptying of the flushing tank for a partial flushing, the unit 10 is turned, according to FIG. 10, into a rotation position in which a longitudinal slot 22 of the unit 10 is aligned with an opening 13 of the housing 1. According to FIG. 10, air can enter into the chamber 9 unhindered and directly from the outside through the opening 13 and the slot 22 in the direction of arrow 58 in this rotation position. The passage is substantially wider than during the passage in the direction of arrow 56, so that the chamber 9 is filled with air very rapidly as soon as the surface of the flushing water 45 reaches the opening 13 according to FIG. 10. The closing member 4 then closes the drain valve before the complete emptying of the flushing tank. The total amount of flushing water, equaling, e.g., 9 L, is used for flushing in the case of complete flushing, and only a partial amount of 6 L is used for the flushing otherwise. The passage of air in the direction of arrow 58 is guaranteed even if the slot 22 is arranged higher.

The unit 10 can be turned into the desired rotation position in relation to the housing 1 by raising the closing member 4 by its top end 7 until a projection 31 arranged on an upper wall 29 (FIG. 1) of the float 3 picks up a projection 32 on the underside of the partition 2 and the closing member 4 is subsequently rotated around its longitudinal axis. The unit 10 is thus carried and rotated in the same direction. The closing member 4 is correspondingly raised by its upper end 7 and rotated for this purpose. Thus, the adjustment is very simple and can be carried out very easily, especially in the case of narrow and tall flushing tanks, e.g., concealed flushing tanks, because it is not necessary to reach deep into the flushing tank.

Figure 6:
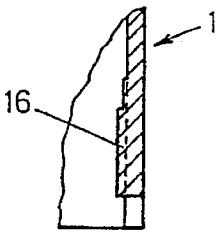
FIG. 6 is a section through part of the housing.
Figure 7:
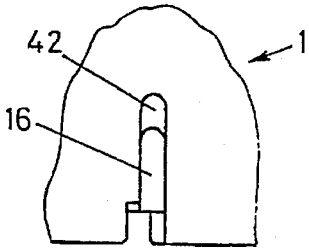
FIG. 7 is a view of the part according to FIG. 6.

The two rotation positions are determined by stop cams 17 on the lower edge of the unit 10 and by support cams 16 on the inside 14 of the housing 1. A circumferential depression 19, which is engaged by a projection 42 (FIGS. 6 and 7), arranged above a support cam 16 according to FIG. 7, is provided between two stop cams 17 in the outside 18 of the unit 10. Depressions 41, into which a respective projection 42 can snap, are provided laterally next to each stop cam 17. The unit 10 can thus be snapped in in either of the two rotation positions. The support cams 16 and the stop cams 17 may be present either as single cams or as multiple cams. This also applies to the snap-in device formed by the projections 42 and depressions 41. According to FIGS. 2 and 3, the stop cams 17 are of a wedge-shaped design, and they glide off laterally on the narrow, projecting cams 16 should the cams 17 accidentally come into contact with the support cams 16 when the unit 10 is placed into the housing 1. The unit 10 can thus be placed into the housing 1 automatically in this respect as well. Visual contact with the cams 17 and 16 is not necessary during manual mounting.

While a specific embodiment of the invention has been shown and described in detail to illustrate the application of the principles of the invention, it will be understood that the invention may be embodied otherwise without departing from such principles.

What is claimed is:

1. A drain valve for a flushing tank, comprising:

a housing fastened to the bottom of said flushing tank, said housing having an upper end with an opening;

a unit including a partition extending horizontally in said housing, said unit including means defining a chamber at an underside of said partition, said unit being removable from said housing;

a closing member displaceably mounted in said housing, said closing member having a sealing body at a lower end, said closing member extending with a top end out of said housing through said opening of said housing, said partition defining an opening receiving said closing member, said closing member being mounted to said unit whereby said unit with said closing member as a single unit can be inserted into and removed from said housing through said opening from a top of said housing without removal of said housing; and a float arranged in said housing under said partition, said float being arranged on said closing member and insertable and removable as a single unit with said unit and said closure member through said housing opening.

2. A drain valve in accordance with claim 1, wherein the said unit is rotatably mounted in said housing.

3. A drain valve in accordance with claim 1, further comprising a housing cover at said upper end of said housing, said housing cover defining said opening, and an upwardly extending tubular wall which is connected to said cover, said tubular wall being fastened to a top of said partition.

4. A drain valve in accordance with claim 3, wherein said cover engages said wall fastened at the top to the said partition to detachably hold said wall.

5. A drain valve in accordance with claim 3 wherein said means defining a chamber and said tubular wall are made in one piece with said partition.

6. A drain valve in accordance with claim 1, further comprising a cover detachably connected to said unit and to said housing.

7. A drain valve in accordance with claim 6, further comprising projecting brackets for rotatably fastening said unit to the said housing wherein said cover is detachably snapped onto said housing.

8. A drain valve in accordance with claim 7, wherein said brackets are made flexibly in one piece with said cover.

9. A drain valve in accordance with claim 1 wherein said unit can be rotated in relation to said housing between at least two predetermined rotational positions to regulate the rate of closing of the drain valve.

10. A drain valve in accordance with claim 9, wherein said housing includes a side opening through which air can enter into said chamber from outside of said housing in one of said rotation positions for premature closing of the drain with partially emptied flushing tank.

11. A drain valve in accordance with claim 9, wherein one of said housing and said unit defines a channel through which air can pass between said unit and said housing to pass from inside of said housing above said partition to said chamber arranged under said partition in one of said rotation positions for retarded closing with said flushing tank partially emptied.

12. A drain valve in accordance with one of the claim 9, further comprising support cams projecting on an inside of said housing and stop cams on said unit cooperating with the said support cams for setting said rotation positions.

13. A drain valve in accordance with claim 12, further comprising recesses defined by said unit, said recesses being arranged on an outside of said unit, extending between said stop cams.

14. A drain valve in accordance with claim 9, further compromising snap means for fixing said unit in one of said rotational positions and another of said rotational positions.

15. A drain valve in accordance with claim 9, wherein said unit has at least one opening under said partition and above said partition through which air can enter into an area under said partition from a top side of said partition.

16. A drain valve in accordance with claim 15, wherein said unit has a longitudinal slot, through which air can enter into said chamber from outside of said housing from a passage opening in said housing when said longitudinal slot and said passage opening are aligned.

17. A drain valve for a flushing tank, comprising:

a housing with a threaded pipe portion for insertion into an opening of a flushing tank bottom;

a unit positionable in said housing, said unit including a partition extending horizontally in said housing and having an annular wall, said annular wall and said partition cooperating to define an annular chamber at an underside of said partition, said unit being removable from said housing;

a closing member displaceably mounted in said housing, said closing member having a sealing body at a lower end, said closing member extending with a top end out of said housing through said opening of the said housing, said partition defining an opening receiving said closing member, said closing member being mounted to said unit whereby said unit with said closing member as a single unit can be inserted into and removed from said housing from a top of said housing without removal of said housing; and a float arranged in said housing under said partition, said float being arranged on said closing member and insertable and removable as a single unit with said unit and said closure member through said housing opening.

18. A drain valve for a flushing tank, comprising: a housing with a threaded pipe portion for insertion into an opening of a flushing tank bottom;

a unit positionable in said housing, said unit including a partition extending horizontally in said housing from one side of said housing to another and having an cylindrical wall, said cylindrical wall and said partition cooperating to define an annular chamber at an underside of said partition, said unit being removable from said housing, said housing including a housing cover at an upper end of said housing, said housing cover defining said opening, said housing cover being removable from said housing whereby said unit and said closing member can be removed from said upper end of said housing without disengaging said housing pipe from said opening a closing member displaceably mounted in said housing, said closing member having a sealing body at a lower end, said closing member extending with a top end out of said housing through said opening of the said housing, said partition defining an opening receiving said closing member, said closing member being mounted to said unit whereby said unit with said closing member as a single unit can be inserted into and removed from said housing through said opening from a top of said housing without removal of said housing; and a float arranged in said housing under said partition, said float being arranged on said closing member and insertable and removable as a single unit with said unit and said closure member through said housing opening.

* * * * *